US005193100A

United States Patent [19]

Hack et al.

[11] Patent Number: 5,193,100

[45] Date of Patent: Mar. 9, 1993

[54] APPARATUS FOR DETECTING GASEOUS DISCHARGE IN VACUUM FURNACES

[75] Inventors: Robert Hack, Lahnau; Wilhelm Polhede, Bruchköbel, both of Fed. Rep. of Germany

[73] Assignee: Arthur Pfeiffer Vakuumtechnik Wetzlar GmbH, Asslar, Fed. Rep. of Germany

[21] Appl. No.: 718,808

[22] Filed: Jun. 21, 1991

[30] Foreign Application Priority Data

Jun. 29, 1990 [DE] Fed. Rep. of Germany ..... 4020818

[51] Int. Cl.[5] ..... F27D 7/06

[52] U.S. Cl. ..... 373/112; 373/109; 373/117; 373/128; 136/230; 174/151; 338/26; 374/24

[58] Field of Search ..... 373/112, 109, 110, 117, 373/127, 128, 129, 130, 135, 69, 70, 25; 136/230, 242; 219/406, 408, 546, 390; 338/26, 28, 214, 238; 374/24, 28; 73/338; 174/151, 152 R, 153 R

[56] References Cited

U.S. PATENT DOCUMENTS

| | | | |
|---|---|---|---|
| 3,553,527 | 1/1971 | Gutsche | 219/121.11 |
| 3,637,438 | 1/1972 | Springfield | 136/230 |
| 3,715,441 | 2/1973 | Collins | 373/155 |
| 3,763,704 | 10/1973 | Blau et al. | 374/140 |
| 3,906,275 | 9/1975 | Spiessens et al. | 313/318 |
| 4,268,708 | 5/1981 | Smith et al. | 373/112 |
| 4,376,227 | 3/1983 | Hilborn | 136/242 |
| 4,491,822 | 1/1985 | Davis | 338/26 |
| 4,826,540 | 5/1989 | Mele | 136/221 |
| 4,952,071 | 8/1990 | Boyer | 374/24 |
| 4,982,055 | 1/1991 | Pollack et al. | 174/151 |

*Primary Examiner*—Bruce A. Reynolds
*Assistant Examiner*—Tu Hoang
*Attorney, Agent, or Firm*—Anderson Kill Olick & Oshinsky

[57] ABSTRACT

An electrically heated vacuum furnace is provided with special lead-through devices for transmitting current to the heating elements. In order to recognize gas discharges which can occur between a lead-through and a tank wall, the insulation of the lead-through is surrounded by an auxiliary electrode. A thermocouple can also be used instead of an auxiliary electrode. A signal derived from the auxiliary electrode can be used to shut off the furnace power to avoid damage thereto.

9 Claims, 3 Drawing Sheets

APPARATUS FOR DETECTING GASEOUS DISCHARGE IN VACUUM FURNACES

The invention is directed to an apparatus for protecting electrically heated vacuum furnaces.

BACKGROUND OF THE INVENTION

Heat treatment furnaces where the heating unit is located inside of a vacuum chamber are provided with special electrical lead-through or feed-through devices, which serve for transmitting the current to the heating elements in the vacuum chamber. These lead-through devices must satisfy severe requirements due to extreme operational circumstances, as for instance high current, high temperatures, sealing tightness, vacuum retention and durability when exposed to high pressure (for instance in pressure sintering furnaces).

In the vicinity of such a lead-through device, an electrical breakdown of the insulating gap path can occur due to mechanical irregularities, as for instance flaws in the insulation ceramics and contamination of the socket or stud passage or due to overvoltage. This can result in a gaseous discharge which is initiated by a high-frequency spark that, however, is present for a time span of only several milliseconds and then continues to exist as an electric arc.

A transfer of material occurs during the gas discharge in the form of an electric arc. Because of this, on the one hand, components between which the gas discharge occurs are weakened by removal of material so that fracture can occur, which causes partial destruction of the lead-through device. On the other hand, the removed material and possible fragments of parts of the lead-through device or their environment constitute a danger for the entire installation as well as a disturbance factor for the method to be performed.

Since such a gas discharge cannot be prevented in spite of all measures to the contrary, it would be greatly advantageous to at least be able to detect same. Detection with the furnace closed in the course of a process is however very difficult. High frequency monitoring is problematic because the high frequency spark is present only for a time span of several milliseconds or less. Thereupon the discharge converts into an electric arc, which cannot be detected by means of high frequency. A detection by insulation resistance in the course of this phase can only be performed with great difficulty, since the insulation resistance between the heating device and other installations, which partially consist of a graphite mat, has a resistance of only a few ohms and since, in addition, the heating voltage is always superimposed on the measurement.

SUMMARY OF THE INVENTION

The chief object of the invention is apparatus which enables detection of a gas discharge inside of an electrically heated vacuum furnace, in order to derive therefrom appropriate measures for protection of the apparatus, such as for instance switching the heating power off.

This object is achieved according to the invention by locating an auxiliary electrode around the insulation of the current lead-through. This auxiliary electrode must be electrically insulated and can, for instance, have the shape of a spiral, or be cross-woven out of wire, or be a sheet metal tube. A gas discharge between the current lead-through and the tank wall results in an easily detectable short-circuit between the auxiliary electrode and the tank wall, which can be detected with commercially available, inherently safe resistance measuring instruments and be processed further into a switching signal for switching-off the heating power and thus extinguishing the electric arc.

According to another aspect of the invention, an alternative construction for detecting a gas discharge consists in winding a thermocouple around the ceramic insulation of the lead-through. If the thermocouple is severed by an electric arc, then either the measuring circuit is opened at this point, or a new connection of both thermocouple legs is formed, which at the instant of its formation generates a high electromotive force corresponding to the high temperature of the new welding bead formed at the thermocouple junction.

Both events, open measuring circuit or high temperature, are positively detectable by commercially available, inherently safe, threshold value switching instruments for thermocouples, so that when an alarm is triggered by the measuring instrument the heating power can be immediately switched off, so that the electric arc is also extinguished. The use of a thermocouple with a metal jacket is advisable for mechanical reasons.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described the preferred embodiments of the invention.

DETAILED DESCRIPTION OF THE PREFERRED EMBODIMENTS

Figure 1:
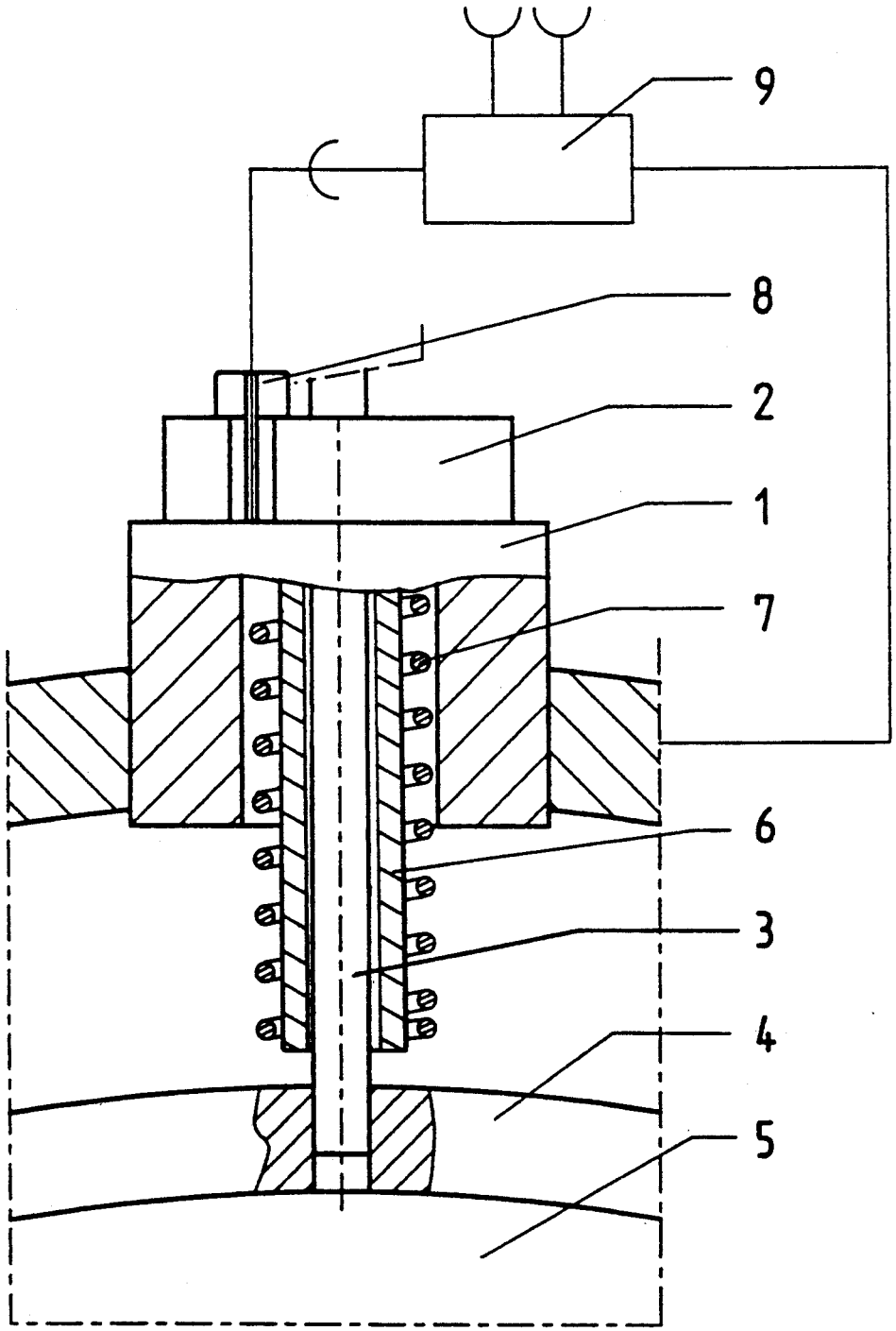
FIG. 1 is a schematic, partially cross-sectioned view of one form or protection apparatus according to the invention.

Referring now to the drawings, a flange 2 is attached to the tank wall 1 of a vacuum furnace provided with an electric lead-through 3 for supplying current for electrical heaters. The lead-through 3 is also referred to hereafter as an electrode. This electrode 3 can consist for instance of copper or graphite. A build-up from a combination of several materials is also possible. The electrode 3 conducts the electric current to the heating elements 4 inside the vacuum chamber 5 of the furnace. The electrode 3 is surrounded by insulation 6 which consists for instance of ceramic material.

An auxiliary electrode 7 is arranged around this insulation 6, which in the example shown has the shape of a spiral. As explained earlier, a gas discharge between the current lead-through 3 and the vacuum tank wall results in an easily detectable short-circuit between the auxiliary electrode 7 and the tank wall, which can be detected with commercially available, inherently safe resistance measuring instruments and be processed further into a switching signal for switching-off the heating power and thus extinguishing the electric arc.

Figure 2:
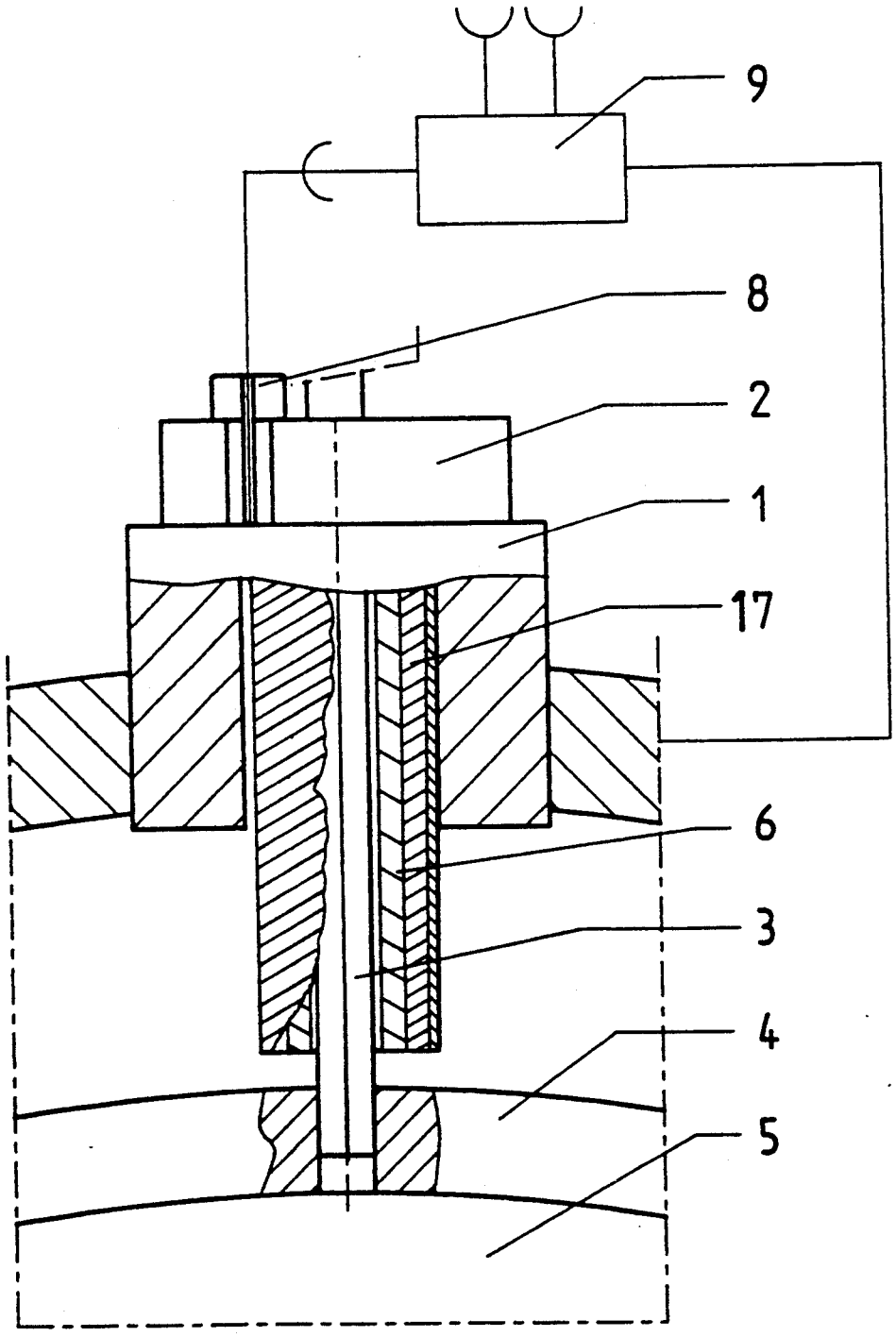
FIGS. 2 and 3 are views similar to FIG. 1 of modifications.
Figure 3:
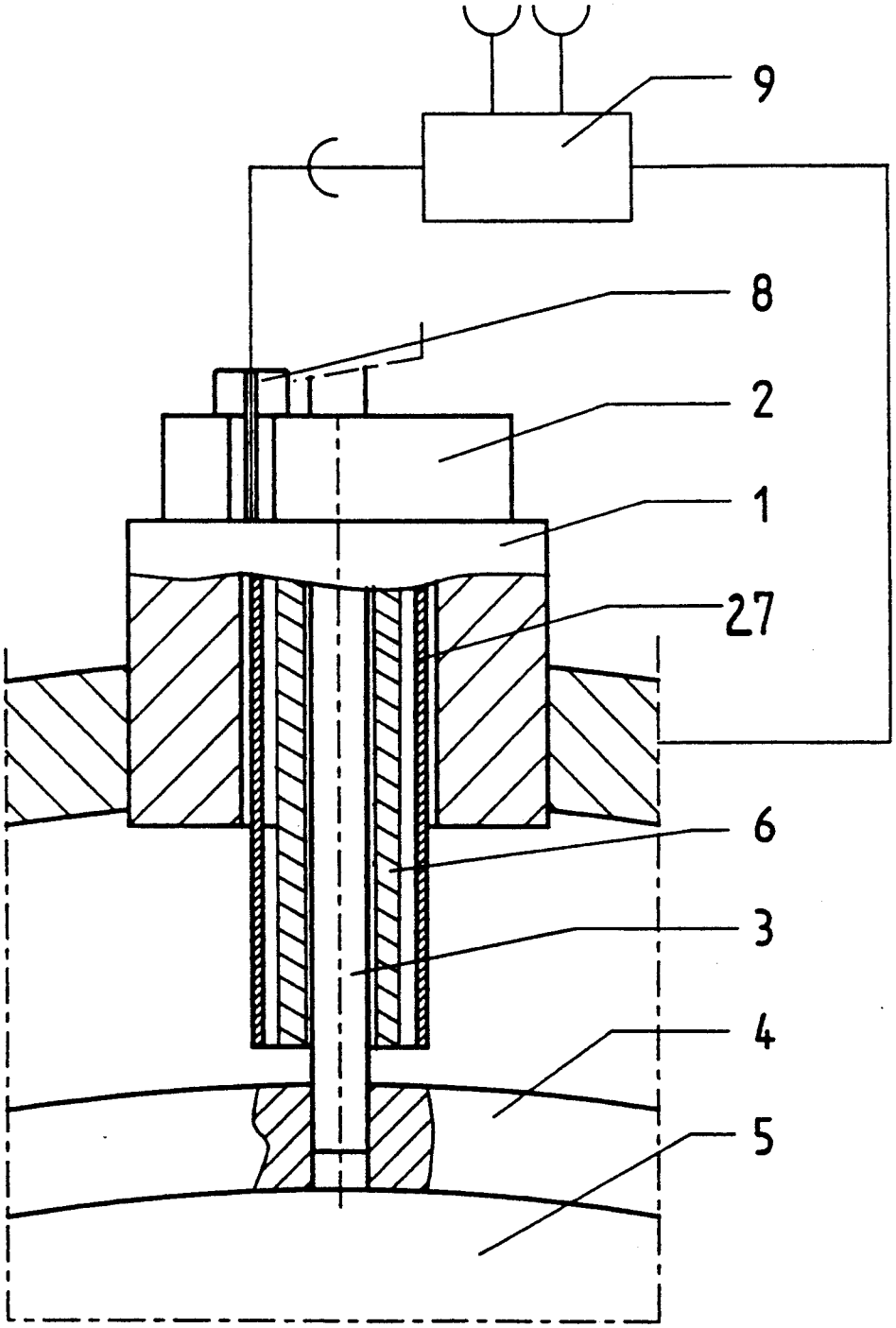

Instead of a spiral electrode 7 as shown in FIG. 1, the auxiliary can be formed from a woven wire as shown at 17 in FIG. 2, or of sheet metal as shown at 27 in FIG. 3, into a tube shape to surround the lead-through insulation.

Instead of the auxiliary electrode 7 in FIG. 1, the insulation 6 can also be surrounded by a thermocouple. The manner of showing this in the drawing is the same.

By means of a lead-through 8, the auxiliary electrode or the thermocouple 7, 17, 27 is led out of the tank space in an electrically insulated manner and is connected to the switch-off electronics 9. The signal resulting from the discharge between the auxiliary electrode and the tank wall is easily detected so as to shut-off the power to avoid damage to the furnace.

While the invention has been described in connection with preferred embodiments, it will be understood that modifications thereof within the principles outlined above will be evident to those skilled in the art and thus the invention is not limited to the preferred embodiments but is intended to encompass such modifications.

We claim:

1. An apparatus for protection of electrically heated vacuum furnaces from gaseous leakage comprising:

heating elements in a vacuum chamber which are provided with a lead-through device that serves for transmitting electrical current to said heating elements wherein said lead-through device is surrounded by a lead-through device insulation;

an auxiliary electrode surrounds said lead-through device insulation; and means for detecting a signal indicative of a gaseous discharge inside a vacuum chamber which is connected to said auxiliary electrode.

2. The apparatus of claim 1 wherein said insulation is a ceramic material.

3. The apparatus of claim 1 further comprising:

a switch-off electronics means for a heating power which is connected to said means for detecting a signal indicative of a gaseous discharge inside a vacuum chamber wherein said switch-off electronics means is actuatable by a signal caused when an electric arc is formed between said lead-through device and a chamber wall and by a consequent drop in resistance between said auxiliary electrode and said chamber wall.

4. The apparatus of claim 1 wherein said auxiliary electrode is wound around said insulation in the shape of a spiral.

5. The apparatus of claim 1 wherein said auxiliary electrode is in the form of a fabric woven from wire.

6. The apparatus of claim 1 wherein said auxiliary electrode is in the form of a metal tube.

7. An apparatus for protection of electrically heated vacuum furnaces from gaseous leakage comprising:

heating elements in a vacuum chamber which is provided with lead-through device that serve for transmitting electrical current to said heating elements wherein said lead-through device is surrounded by an insulation; a thermocouple which surrounds said lead-through device insulation; and means for detecting a signal indicative of an electric discharge inside said vacuum chamber which is connected to said thermocouple.

8. The apparatus of claim 7 wherein said insulation is of ceramic material.

9. The apparatus of claim 7 further comprising:

a switch-off electronics means for a heating power connected to said means for detecting a signal wherein said switch-off electronics means is actuatable by a signal caused when an electric arc is formed between said lead-through device and a chamber wall by one of a consequent excessive temperature indication from said thermocouple and after a burn-through of said thermocouple.

* * * * *